US009900955B1

(12) United States Patent
Kendle

(10) Patent No.: US 9,900,955 B1
(45) Date of Patent: Feb. 20, 2018

(54) LUMINAIRE HAVING AN ADJUSTABLE COLOR TEMPERATURE OF EMITTED LIGHT AND RELATED METHODS

(71) Applicant: DELTA T CORPORATION, Lexington, KY (US)

(72) Inventor: Paul D. Kendle, Georgetown, KY (US)

(73) Assignee: DELTA T CORPORATION, Lexington, KY (US)

( * ) Notice: Subject to any disclaimer, the term of this patent is extended or adjusted under 35 U.S.C. 154(b) by 0 days.

(21) Appl. No.: 15/399,781

(22) Filed: Jan. 6, 2017

Related U.S. Application Data

(60) Provisional application No. 62/275,594, filed on Jan. 6, 2016.

(51) Int. Cl.
*H05B 33/08* (2006.01)

(52) U.S. Cl.
CPC ..... *H05B 33/086* (2013.01); *H05B 33/0809* (2013.01); *H05B 33/0845* (2013.01)

(58) Field of Classification Search
CPC ..... H05B 33/08; H05B 33/0806; H05B 33/0845; H05B 33/0833; H05B 33/0857; H05B 37/02
See application file for complete search history.

(56) References Cited

U.S. PATENT DOCUMENTS

| | | | | |
|---|---|---|---|---|
| 7,902,771 | B2 * | 3/2011 | Shteynberg | H05B 33/0815 315/185 R |
| 2006/0049782 | A1 * | 3/2006 | Vornsand | H05B 33/0869 315/312 |
| 2009/0284172 | A1 * | 11/2009 | Maschietto | H05B 33/083 315/294 |
| 2012/0038287 | A1 * | 2/2012 | Li | H05B 33/0854 315/250 |
| 2013/0063035 | A1 * | 3/2013 | Baddela | H05B 33/086 315/192 |
| 2014/0035472 | A1 * | 2/2014 | Raj | H05B 33/0863 315/185 R |

* cited by examiner

*Primary Examiner* — Thai Pham
(74) *Attorney, Agent, or Firm* — King & Schickli, PLLC

(57) ABSTRACT

A luminaire having an adjustable color temperature of emitted light includes an input device for receiving an input indicative of a desired color temperature, first, second and third LED arrays each array having different color temperatures, a first LED driver for driving one of the first and third LED arrays, a second LED driver for driving the second LED array, an LED array selector for selectively driving the one of the first and third LED arrays dependent upon the input, and a processor for determining which of the first and the third LED arrays to drive based on the input and controlling the LED array selector and the second LED driver dependent upon the input. The processor utilizes analog dimming above a predetermined noise threshold voltage and PWM dimming below the predetermined noise threshold voltage and combinations thereof. A related method of adjusting a color temperature of light emitted from a luminaire is also provided.

21 Claims, 5 Drawing Sheets

LUMINAIRE HAVING AN ADJUSTABLE COLOR TEMPERATURE OF EMITTED LIGHT AND RELATED METHODS

This application claims the benefit of U.S. Provisional Patent Application No. 62/275,594, filed Jan. 6, 2016, the disclosure of which is incorporated herein by reference.

TECHNICAL FIELD

This application relates to the lighting arts and, in particular, an adjustable luminaire.

BACKGROUND

Luminaires or lighting fixtures are used for providing artificial light where needed, such as in buildings or outdoor areas. A typical luminaire may include a plurality of light emitting diode (LED) arrays in order to provide different color temperatures of emitted light. In such a scenario, each LED array provides light of a specific temperature (e.g., 2200 k, 2700 k, and/or 5000 k). Each array is typically driven by a designated LED driver and related circuitry and the emitted light is combined in order to provide a desired color temperature of emitted light.

It would be beneficial to have an improved luminaire that provides the ability to adjust the color temperature of emitted light utilizing at least one less LED driver than LED arrays. It would be further beneficial if the luminaire were capable of efficiently combining color temperatures of light emitted from different LED arrays even under dimming conditions without creating unwanted noise. The luminaire would allow for smaller packaging and could be adjusted in a variety of manners in order to achieve the desired objectives of tuned lighting. Related improvements are also proposed.

SUMMARY OF THE INVENTION

In accordance with the purposes and benefits described herein, a luminaire having an adjustable color temperature of emitted light is provided. The luminaire may be broadly described as including an input device for receiving an input indicative of a desired color temperature of emitted light, first, second and third LED arrays each array having a different color temperature, a first LED driver for driving one of the first and third LED arrays, a second LED driver for driving the second LED array, an LED array selector for selecting one of the first and third LED arrays to be driven by the first LED driver dependent upon the input, and a processor for determining which of the first and the third LED arrays to select based on the input and controlling the LED array selector and the second LED driver dependent upon the input.

In still another possible embodiment, the processor dims at least one of the first, second, and third LED arrays so the combined color temperature of light emitted from the first, second, and third LED arrays is substantially equal to the desired color temperature of emitted light.

In one other possible embodiment, the processor utilizes analog dimming above a predetermined noise threshold voltage and pulse width modulation dimming at or below the predetermined noise threshold voltage. In yet another, the analog dimming is maintained at a constant level substantially equal to the predetermined noise level voltage and pulse width modulation dimming is utilized to control dimming at or below the predetermined noise level voltage by varying the duty cycle.

In still another possible embodiment, the color temperature of the first LED array is 2200K, the color temperature of the second LED array is 2700K, and the color temperature of the third LED array is 5000K. In this embodiment, the processor may utilize analog dimming above a predetermined noise threshold voltage and pulse width modulation dimming below the predetermined noise threshold voltage. In another, the analog dimming may be maintained at a constant level substantially equal to the predetermined noise level voltage and pulse width modulation dimming is utilized to control dimming below the predetermined noise level voltage by varying the duty cycle.

In accordance with still yet another possible embodiment, a luminaire having an adjustable color temperature of emitted light is provided. The luminaire may be broadly described as including an input device for receiving an input indicative of a desired color temperature of emitted light, at least three LED arrays each array having different color temperatures, at least two LED drivers for driving at least one of the at least three LED arrays, at least one LED array selector for selectively driving two of the at least three LED arrays dependent upon the input, and a processor for determining which of the at least three LED arrays to drive based on the input and controlling the at least one LED array selector and the at least two LED drivers dependent upon the input.

In accordance with the purposes and benefits described herein, a method is provided of adjusting a color temperature of light emitted from a luminaire having first, second and third LED arrays, each array having a different color temperature. The method may be broadly described as comprising the steps of: receiving an input indicative of a desired color temperature of light emitted from the luminaire; processing the input and providing signals to first and second LED drivers, and an LED array selector dependent upon the input; and driving at least one of the first, second and third LED arrays utilizing at least one of the first LED driver and the second LED driver according to the signals so the combined color temperatures of light emitted from the at least one of the first, second and third LED arrays is substantially the same as the desired color temperature of light emitted from the luminaire.

In another possible embodiment, the step of driving at least one of the first, second and third LED arrays includes driving one of the first, second and third LED arrays with the first LED driver when the desired color temperature of light emitted from the luminaire is equal to the color temperature of light emitted from the one of the first, second and third LED arrays.

In yet another possible embodiment, the step of driving at least one of the first, second and third LED arrays includes driving the first LED array with the first LED driver and the second LED array with the second LED driver when the desired color temperature of light emitted from the luminaire is between the color temperature of the first LED array and the color temperature of the second LED array.

In one other possible embodiment, the method further includes the step of dimming at least one of the first LED array and the second LED array so the combined color temperatures of the light emitted from the first LED array and the light emitted from the second LED array are substantially equal to the desired color temperature of light emitted from the luminaire.

In still another possible embodiment, the step of dimming utilizes analog dimming above a predetermined noise threshold voltage and pulse width modulation dimming below the predetermined noise threshold voltage. In another, the analog dimming is maintained at a constant level substantially equal to the predetermined noise level voltage and pulse width modulation dimming is utilized to control dimming below the predetermined noise level voltage by varying the duty cycle.

In still another, the step of selectively driving at least one of the first, second and third LED arrays includes driving the third LED array with the first LED driver and the second LED array with the second LED driver when the desired color temperature of light emitted from the luminaire is between the color temperature of the second LED array and the color temperature of the third LED array.

In still another possible embodiment, the method further includes the step of dimming at least one of the second LED array and the third LED array so the combined color temperatures of the light emitted from the second LED array and the light emitted from the third LED array are substantially equal to the desired color temperature of light emitted from the luminaire.

In yet another possible embodiment, the step of dimming utilizes analog dimming above a predetermined noise threshold voltage and pulse width modulation dimming below the predetermined noise threshold voltage. In still another, the analog dimming is maintained at a constant level substantially equal to the predetermined noise level voltage and pulse width modulation dimming is utilized to control dimming below the predetermined noise level voltage by varying the duty cycle.

In accordance with another aspect of the invention, a method is provided of adjusting a color temperature of light emitted from a luminaire. The method comprises the steps of providing first, second and third LED arrays having different color temperatures, providing first and second LED drivers, and selectively driving at least one of the first, second and third LED arrays utilizing at least one of the first LED driver and the second LED driver dependent upon a desired color temperature of the luminaire.

In one other possible embodiment, the method further includes the step of dimming at least one of the first, second, and third LED arrays so the combined color temperature of the light emitted from the first, second, and third LED arrays is substantially equal to the desired color temperature.

In another possible embodiment, the step of dimming utilizes analog dimming above a predetermined noise threshold voltage and pulse width modulation dimming below the predetermined noise threshold voltage.

In the following description, there are shown and described several embodiments of a luminaire having an adjustable color temperature of emitted light, and related methods of adjusting the color temperature of light emitted from the luminaire. As it should be realized, the invention is capable of other, different embodiments and its several details are capable of modification in various, obvious aspects all without departing from the invention as set forth and described in the following claims. For example, the luminaire is scalable to accommodate any number of LED arrays having different color temperatures. Accordingly, the drawings and descriptions should be regarded as illustrative in nature and not as restrictive.

BRIEF DESCRIPTION OF THE DRAWINGS

The accompanying drawing figures incorporated herein and forming a part of the specification, illustrate several aspects of the vehicle having an auxiliary duct pivotally attached to a console and together with the description serve to explain certain principles thereof. In the drawing figures.

Reference will now be made in detail to the present preferred embodiments of the luminaire and related methods, examples of which are illustrated in the accompanying drawing figures.

DETAILED DESCRIPTION

Figure 1:
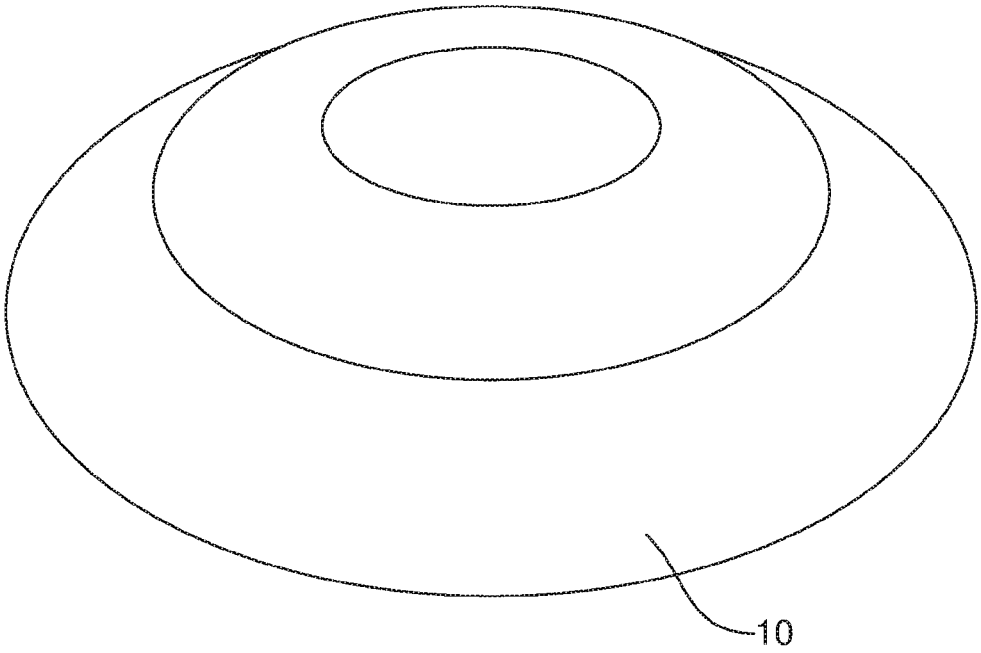
FIG. 1 is a perspective view of a luminaire.

Reference is now made to FIG. 1 which illustrates one embodiment of a luminaire 10. In the described embodiment, the luminaire 10 is designed for mounting on a ceiling. However, any form of luminaire utilizing multiple LED arrays having different color temperatures may utilize the present invention. While three LED arrays are utilized in the described embodiment, the invention is scalable to accommodate any number of LED arrays having different color temperatures which allows the luminaire to more closely approximate a blackbody curve for white light.

Figure 2:
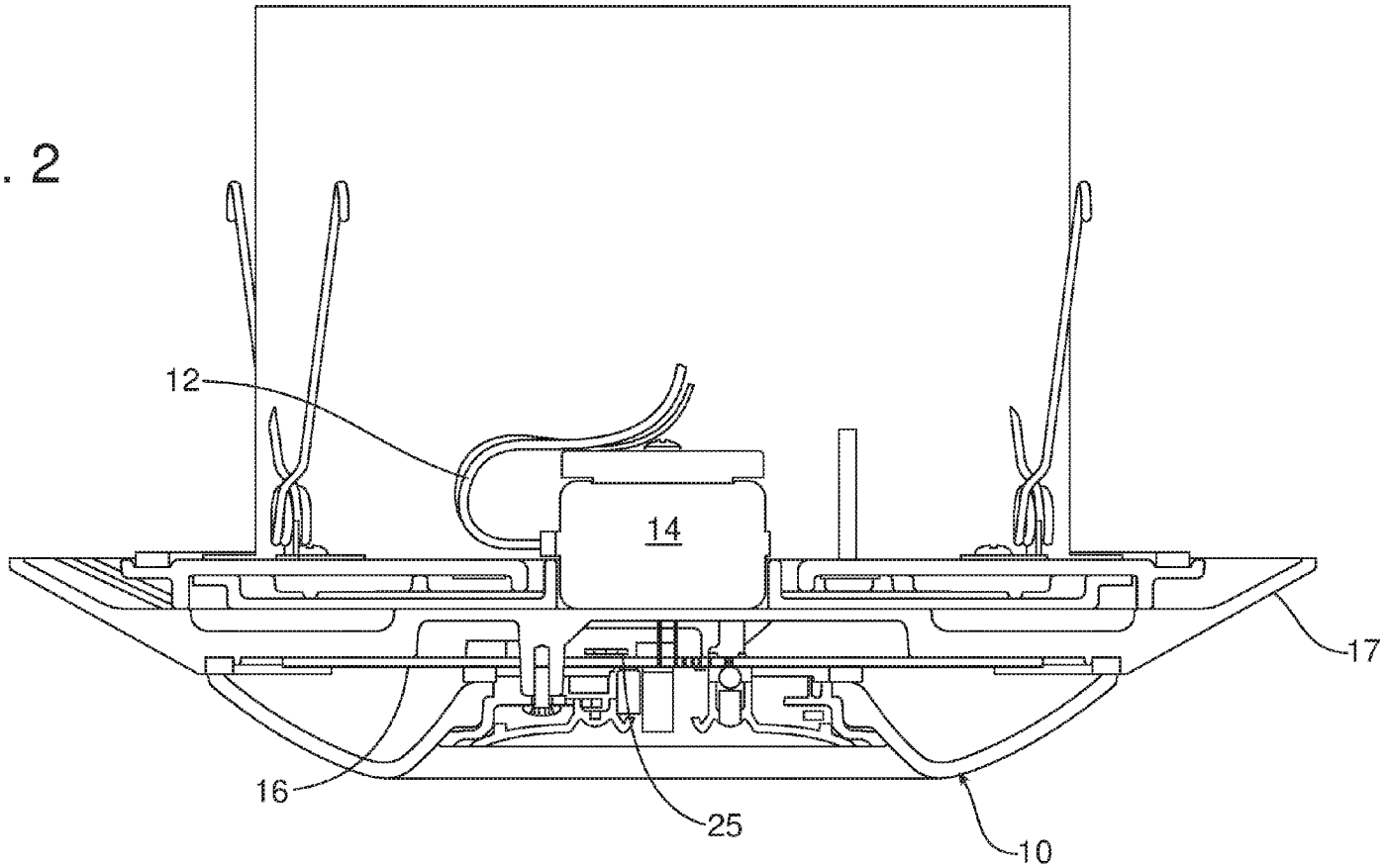
FIG. 2 is a cross sectional plan view of the luminaire.
Figure 3:
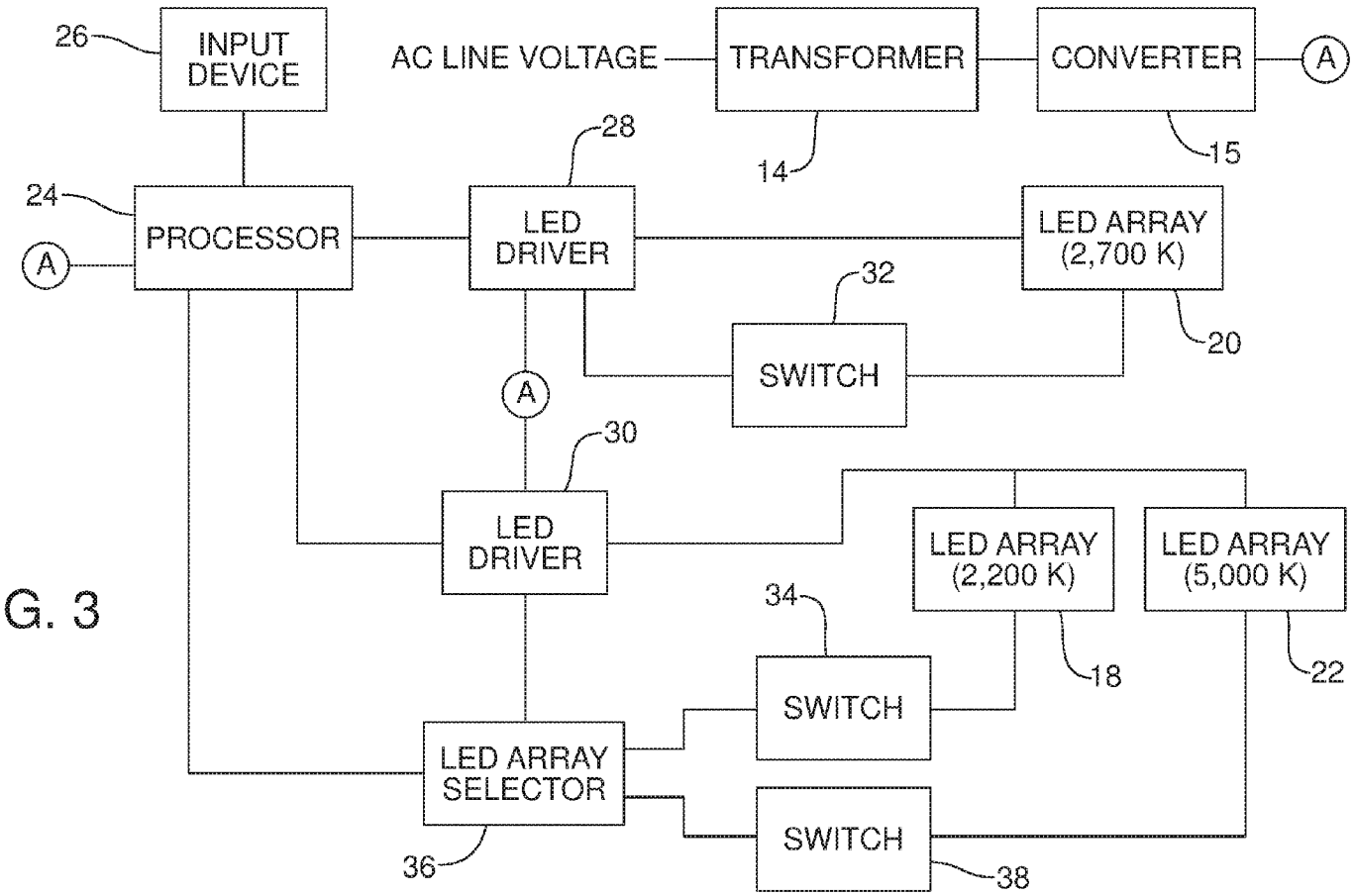
FIG. 3 is a block schematic diagram of the luminaire.

As shown in FIG. 2, the luminaire 10 includes wires 12 for connecting to residential power or an alternate power source. The wires 12 can be spliced directly to residential power or electrically connected through a connector. A transformer 14 steps the AC line voltage down to 24 volt DC which is further stepped down by a synchronous DC-DC converter 15 as shown in FIG. 3. In the described embodiment, the DC-DC converter 15 is a Texas Instruments® LM43601 regulator capable of driving up to 1 A of load current from an input voltage ranging from 3.5 V to 36 V (42 V transient). The regulator 15 is mounted on an LED board 16 shown in FIG. 2. The LED board 16 in turn is mounted in contact with a heat sink 17.

The 24 volt DC and 3.3 volt DC signals are used throughout the LED board 16 to drive first, second and third LED arrays 18, 20, 22, and to adjust a color temperature of light emitted from the luminaire 10. In the described embodiment, the first LED array 18 (or LED ring) includes four strings of twelve LEDs. Each of the LEDs in the first LED array have a color temperature of 2200K. The second LED array 20 and third LED array 22 each also include four strings of twelve LEDs. Each of the LEDs in the second LED array 20 have a color temperature of 2700K and each of the LEDs in the third LED array 22 have a color temperature of 5000K. Depending on how the first, second and third LED arrays are controlled/driven, the color temperature of the combined light emitted from the luminaire 10 can be adjusted from 2200K through and including 5000K. In other words, the color temperature can be 2200K, 5000K, or any number therebetween (e.g., 2237K). In addition, the LED arrays may have other color temperatures (e.g., 4200K, 4000K, 3200K, 3000K, etc.) or may include combinations of LEDs having different temperatures.

As further shown in FIG. 3, a processor 24, powered by converter 15, is mounted on the LED board 16 receives an input signal from an input device 26. In the described embodiment, the processor 24 is a Freescale Semiconductor Inc. MK12DX256VLF5 32-bit microcontroller and the input device 26 is a WIFI radio. In alternate embodiments, the input device 26 could be any type of device (e.g., an IR receiver, a light sensor, and/or an occupancy sensor) capable of receiving a user input indicative of a desired color temperature of the light emitted from the luminaire 10. The device could receive signals via the WIFI radio from a wall mounted control, a hand-held control, and/or a smartphone. Typically, the input device provides up/down arrows for inputting the desired color temperature, however, any device capable of indicating a desired temperature is sufficient. The input device 26 may also be directly wired to the luminaire 10.

Algorithms within the processor 24 determine whether a first LED driver 28 and a second LED driver 30 are used to drive the first, second and/or third LED arrays 18, 20, 22. The processor 24 outputs a control signal to the first LED driver 28 which outputs a gate drive signal for driving the second LED array 20. In the described embodiment, the first and second LED drivers 28, 30 each include a Linear Technology® LT3756 DC/DC controller designed to operate as a constant-current source for driving high current LEDs, an inductor, and a switch. The inductors are Coilcraft® LPS6235 series low profile shielded power inductors and the switches are ON Semiconductor NTTFS5826NL power MOSFETs. A switch 32 controlled by the processor 24 turns the second LED array 20 on/off. In the described embodiment, the switch 32 is an Infineon® BSZ100N06LS3 G power transistor.

The processor 24 further outputs a control signal to the second LED driver 30 which outputs a gate drive signal for selectively driving the first LED array 18 or the third LED array 22. In the described embodiment, a switch 34 controlled by an LED array selector 36 turns the first LED array 18 on/off and a second switch 38 controlled by the LED array selector turns the third LED array 22 on/off. In the described embodiment, the switches 34 and 38 are both Infineon® BSZ100N06LS3 G power transistors and the LED array selector 36 is a Texas Instruments® UCC27524DGNR dual, high-speed, low-side power MOSFET driver.

Determination as to whether the first LED array 18 or the third LED array 22 is operated depends on the input signal from the input device 26. If the desired color temperature of light emitted from the luminaire 10 is between 2200K and 2700K, the first LED array 18 and the second LED array 20 are utilized to create a combination of light which approximates the blackbody curve for white light and substantially equals the desired color temperature. Similarly, if the desired color temperature of light emitted from the luminaire 10 is between 2700K and 5000K, the second LED array 20 and the third LED array 22 are utilized to create a combination of light substantially equal to the desired color temperature. In the event the desired color temperature is the same as the color temperature of one of the three LED arrays, then only one LED driver is utilized and only one LED array is turned on.

As indicated above, the LED array selector 36 is utilized to selectively drive one of the first LED array 18 and the third LED array 22 with the second LED driver 30 as shown in FIG. 3. In the described embodiment, the LED array selector 36 receives controls signals from the processor 24 which determines whether the LED array selector 36 passes an output signal from the second LED driver 30 to the switch 34 or the second switch 38 in order to turn the first LED array 18 or the third LED array 22 on/off respectively.

Figure 4:
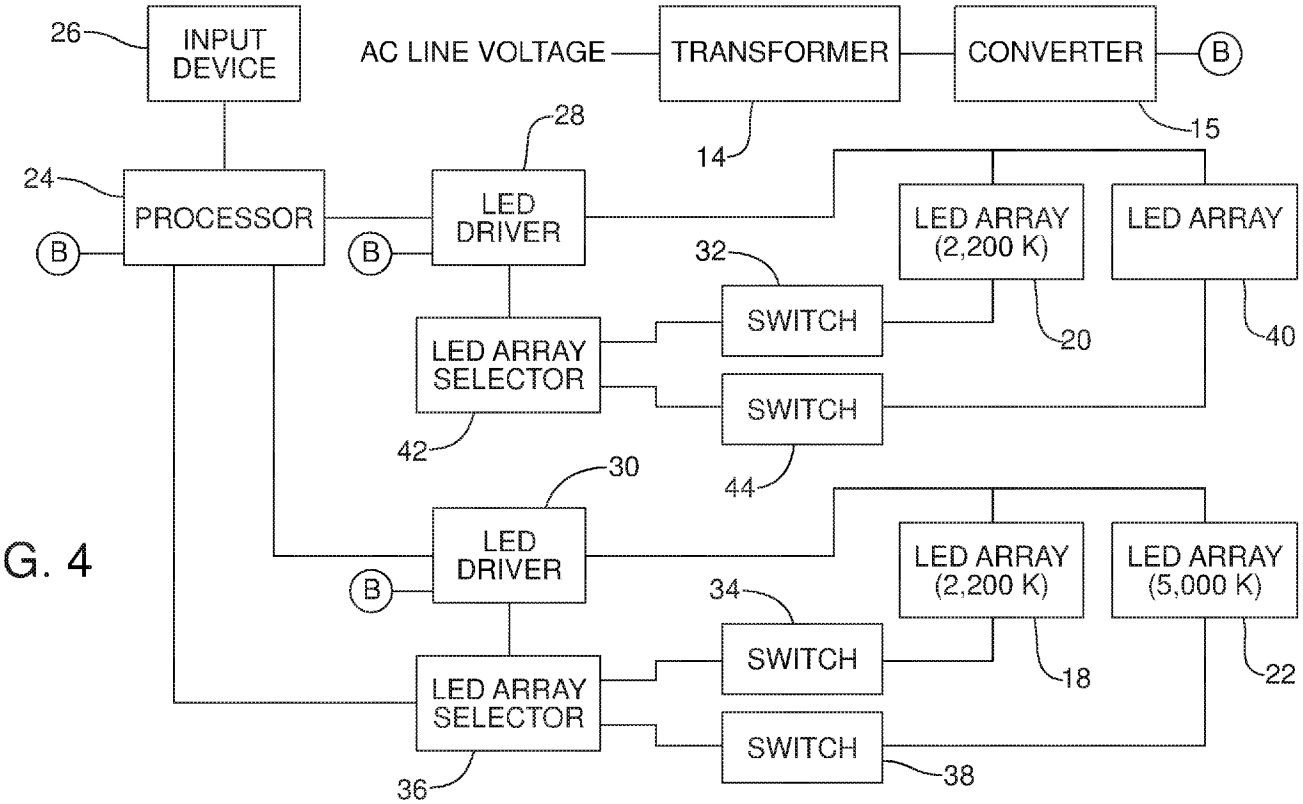
FIG. 4 is a block schematic diagram of an alternate luminaire having four LED arrays having different color temperatures.

As shown in FIG. 4, the above-described circuit can be expanded to accommodate any number of LED arrays. As shown, the alternate circuit includes three LED arrays, as in the previously described circuit, and a fourth LED array 40. In order to select between the second LED array 20 and the fourth LED array 40, an additional LED array selector 42 and switch 44 are added to the circuit described in FIG. 3. The additional LED array selector 42 and switch 44 operate the same as the LED array selector 36 and switches 34 and 38 described above except the new LED array selector and switch control whether the second LED array 20 or the fourth LED array 40 are operated.

In order to accommodate the efficient combining of color temperatures of light emitted from different LED arrays under dimming conditions and without creating unwanted noise, a combination of analog and pulse width modulation (PWM) dimming is utilized. This provides for an improved dimming ratio than either analog or PWM dimming can achieve individually. More specifically, analog dimming has a useful range of 10:1 and is limited by noise in the system below a certain threshold.

Figure 5:
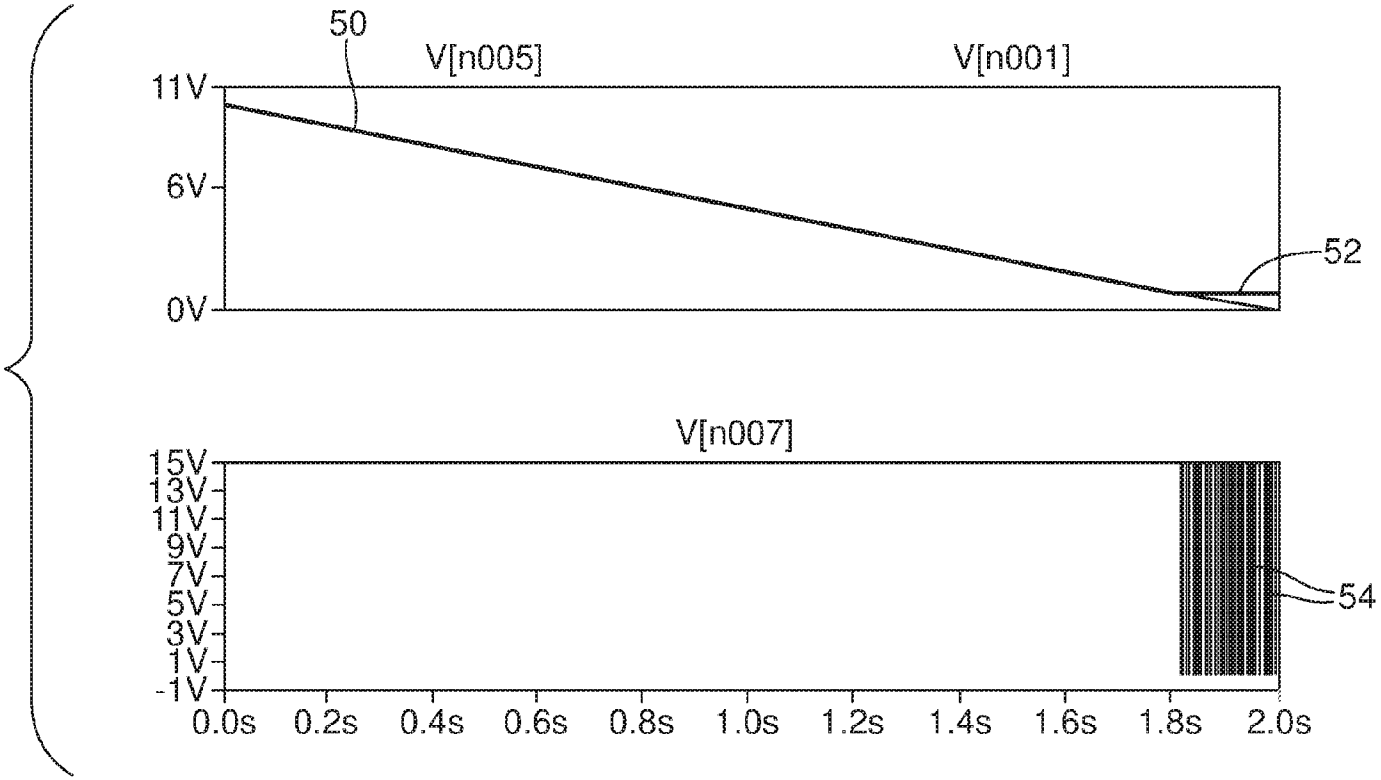
FIG. 5 is a graphical representation of analog and PWM dimming levels.

As shown in FIG. 5, as an analog signal level 50 decreases during dimming over a period of 1.8 seconds, the signal level approaches a noise level threshold 52 at or near 250 millivolts. It should be noted that the LEDs turn off at around 100 millivolts. Near the 250 millivolt level, resolution is lost due to the noise. However, PWM dimming has a useful range of 3000-5000:1 which is limited by LED driver response time. By combining analog and PWM dimming, a dimming ratio of 50000:1 can be approached. While single color systems are unlikely to need a 50000:1 dimming ratio, the added dimming capability allows for smoother color temperature transitions at low lumen output when mixing colors as in the present embodiment. The line 50 in the plot shown in FIG. 5 represents an analog signal level decreasing linearly. At the predefined noise threshold level 52, the analog signal level is held constant and PWM dimming is initiated and utilized and further dimming made by reducing the duty cycle as represented by line 54.

In the described embodiment, dimming is utilized to better approximate the desired color temperature. In other words, at least one of the first LED array 18 or the third LED array 22, and the second LED array 20 are dimmed so the combined color temperatures of the light emitted from the first LED array or the third LED array, and the light emitted from the second LED array are substantially equal to the desired color temperature. The processor 24 utilizes both analog dimming above a predetermined noise threshold voltage and PWM dimming below the predetermined noise threshold voltage. More specifically, the analog dimming is maintained at a constant level substantially equal to the predetermined noise level voltage and PWM dimming is utilized to control dimming below the predetermined noise level voltage by varying the duty cycle.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

The invention claimed is:

1. A luminaire having an adjustable color temperature of emitted light, comprising:

an input device for receiving an input indicative of a desired color temperature of emitted light;

first, second and third LED arrays each array having a different color temperature;

a first LED driver for driving one of said first and third LED arrays;

a second LED driver for driving said second LED array;

an LED array selector for selecting one of said first and third LED arrays to be driven by said first LED driver dependent upon the input; and a processor for determining which of said first and said third LED arrays to select based on the input and controlling said LED array selector and said second LED driver dependent upon the input.

2. The luminaire having an adjustable color temperature of emitted light of claim 1, wherein said processor dims at least one of said first, second, and third LED arrays so the combined color temperature of light emitted from the first, second, and third LED arrays is substantially equal to the desired color temperature of emitted light.

3. The luminaire having an adjustable color temperature of emitted light of claim 2, wherein said processor utilizes analog dimming above a predetermined noise threshold voltage and pulse width modulation dimming at or below the predetermined noise threshold voltage.

4. The luminaire having an adjustable color temperature of emitted light of claim 3, wherein the analog dimming is maintained at a constant level substantially equal to the predetermined noise level voltage and pulse width modulation dimming is utilized to control dimming at or below the predetermined noise level voltage by varying the duty cycle.

5. The luminaire having an adjustable color temperature of emitted light of claim 1, wherein the color temperature of said first LED array is 2200K, the color temperature of said second LED array is 2700K, and the color temperature of said third LED array is 5000K.

6. The luminaire having an adjustable color temperature of emitted light of claim 5, wherein said processor utilizes analog dimming above a predetermined noise threshold voltage and pulse width modulation dimming below the predetermined noise threshold voltage.

7. The luminaire having an adjustable color temperature of emitted light of claim 6, wherein the analog dimming is maintained at a constant level substantially equal to the predetermined noise level voltage and pulse width modulation dimming is utilized to control dimming below the predetermined noise level voltage by varying the duty cycle.

8. A luminaire having an adjustable color temperature of emitted light, comprising:

an input device for receiving an input indicative of a desired color temperature of emitted light;

at least three LED arrays each of said at least three LED arrays having different color temperatures;

at least two LED drivers for driving at least one of said at least three LED arrays;

at least one LED array selector for selectively driving two of said at least three LED arrays dependent upon the input; and a processor for determining which of said at least three LED arrays to drive based on the input and controlling said at least one LED array selector and said at least two LED drivers dependent upon the input.

9. A method of adjusting a color temperature of light emitted from a luminaire having first, second and third LED arrays, each array having a different color temperature, comprising the steps of:

receiving an input indicative of a desired color temperature of light emitted from the luminaire;

processing the input and providing signals to first and second LED drivers, and an LED array selector dependent upon the input;

driving at least one of the first, second and third LED arrays utilizing at least one of said first LED driver and said second LED driver according to said signals so the combined color temperatures of light emitted from said at least one of the first, second and third LED arrays is substantially the same as the desired color temperature of light emitted from the luminaire.

10. The method of adjusting a color temperature of light emitted from a luminaire having first, second and third LED arrays, each array having a different color temperature of claim 9, wherein the step of driving at least one of said first, second and third LED arrays includes driving one of said first, second and third LED arrays with one of said first and second LED drivers when the desired color temperature of light emitted from the luminaire is equal to the color temperature of light emitted from the one of said first, second and third LED arrays.

11. The method of adjusting a color temperature of light emitted from a luminaire having first, second and third LED arrays, each array having a different color temperature of claim 9, wherein the step of driving at least one of said first, second and third LED arrays includes driving said first LED array with said first LED driver and said second LED array with said second LED driver when the desired color temperature of light emitted from the luminaire is between the color temperature of said first LED array and the color temperature of said second LED array.

12. The method of adjusting a color temperature of light emitted from a luminaire having first, second and third LED arrays, each array having a different color temperature of claim 11, further comprising the step of dimming at least one of said first LED array and said second LED array so the combined color temperatures of the light emitted from said first LED array and the light emitted from said second LED array are substantially equal to the desired color temperature of light emitted from the luminaire.

13. The method of adjusting a color temperature of light emitted from a luminaire having first, second and third LED arrays, each array having a different color temperature of claim 12, wherein the step of dimming utilizes analog dimming above a predetermined noise threshold voltage and pulse width modulation dimming below the predetermined noise threshold voltage.

14. The method of adjusting a color temperature of light emitted from a luminaire having first, second and third LED arrays, each array having a different color temperature of claim 13, wherein the analog dimming is maintained at a constant level substantially equal to the predetermined noise level voltage and pulse width modulation dimming is utilized to control dimming below the predetermined noise level voltage by varying the duty cycle.

15. The method of adjusting a color temperature of light emitted from a luminaire having first, second and third LED arrays, each array having a different color temperature of claim 9, wherein the step of selectively driving at least one of said first, second and third LED arrays includes driving said third LED array with said first LED driver and said second LED array with said second LED driver when the desired color temperature of light emitted from the luminaire is between the color temperature of said second LED array and the color temperature of said third LED array.

16. The method of adjusting a color temperature of light emitted from a luminaire having first, second and third LED arrays, each array having a different color temperature of claim 15, further comprising the step of dimming at least one of said second LED array and said third LED array so the combined color temperatures of the light emitted from said second LED array and the light emitted from said third LED array are substantially equal to the desired color temperature of light emitted from the luminaire.

17. The method of adjusting a color temperature of light emitted from a luminaire having first, second and third LED arrays, each array having a different color temperature of claim 16, wherein the step of dimming utilizes analog dimming above a predetermined noise threshold voltage and pulse width modulation dimming below the predetermined noise threshold voltage.

18. The method of adjusting a color temperature of light emitted from a luminaire having first, second and third LED arrays, each array having a different color temperature of claim 17, wherein the analog dimming is maintained at a constant level substantially equal to the predetermined noise level voltage and pulse width modulation dimming is utilized to control dimming below the predetermined noise level voltage by varying the duty cycle.

19. A method of adjusting a color temperature of light emitted from a luminaire, comprising:

providing first, second and third LED arrays each array having a different color temperature;

providing first and second LED drivers;

selectively driving at least one of said first, second and third LED arrays utilizing at least one of said first LED driver and said second LED driver dependent upon a desired color temperature of the luminaire.

20. The method of adjusting a color temperature of light emitted from a luminaire of claim 19, further comprising the step of dimming at least one of said first, second, and third LED arrays so the combined color temperature of the light emitted from said first, second, and third LED arrays is substantially equal to the desired color temperature.

21. The method of adjusting a color temperature of light emitted from a luminaire of claim 20, wherein the step of dimming utilizes analog dimming above a predetermined noise threshold voltage and pulse width modulation dimming below the predetermined noise threshold voltage.

* * * * *